US006209291B1

(12) United States Patent
Delén et al.

(10) Patent No.: US 6,209,291 B1
(45) Date of Patent: Apr. 3, 2001

(54) METHOD OF PRODUCING CREASE-LINED PACKAGING MATERIAL

(75) Inventors: Anders Delén, Kävlinge; Mats Martinsson, Lövestad; Johnny Pedersen, Sjöbo; Tor Söderlund, Malmö, all of (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/277,737

(22) Filed: Mar. 29, 1999

(30) Foreign Application Priority Data

Apr. 7, 1998 (SE) ..... 9801256

(51) Int. Cl.[7] ..... B65B 9/00; B65B 9/13

(52) U.S. Cl. ..... 53/450; 53/452; 53/463; 493/194; 493/231; 493/428

(58) Field of Search ..... 493/194, 199, 493/243, 231, 434, 435, 428, 432; 53/450, 452, 455, 462, 463

(56) References Cited

U.S. PATENT DOCUMENTS

| | | | | |
|---|---|---|---|---|
| 3,411,419 | * | 11/1968 | Backer et al. | 493/192 |
| 3,658,220 | | 4/1972 | Norton . | |
| 3,844,201 | | 10/1974 | Eggert et al. . | |
| 4,006,656 | | 2/1977 | Shinomiya . | |
| 4,371,364 | | 2/1983 | Rausing . | |
| 4,931,031 | * | 6/1990 | Lisiecki | 493/355 |
| 4,998,657 | | 3/1991 | Ramsay et al. . | |
| 5,223,194 | * | 6/1993 | Rosen | 264/46.1 |
| 5,509,885 | | 4/1996 | Brunlid . | |
| 5,727,367 | * | 3/1998 | Cahill et al. | 53/462 |

FOREIGN PATENT DOCUMENTS

| | | |
|---|---|---|
| 1214521 | 4/1966 | (DE) . |

* cited by examiner

*Primary Examiner*—Peter Vo
*Assistant Examiner*—Hemant M. Desai
(74) *Attorney, Agent, or Firm*—Burns, Doane, Swecker & Mathis, L.L.P.

(57) ABSTRACT

The disclosure relates to a method of producing crease-lined packaging material with a high degree of accuracy as regards the placing and forming of longitudinal crease lines. A web-shaped starting material (1) is provided, in connection with the laminate production, with a pattern of crease lines (6) extending at an angle to the longitudinal direction of the web, whereafter the material is divided into part webs (9). In connection with the conversion of each part web (9) into individual packaging containers in a filling machine, each part web is provided with complementary, longitudinal crease lines (17, 18).

7 Claims, 1 Drawing Sheet

METHOD OF PRODUCING CREASE-LINED PACKAGING MATERIAL

TECHNICAL FIELD

Figure 1:
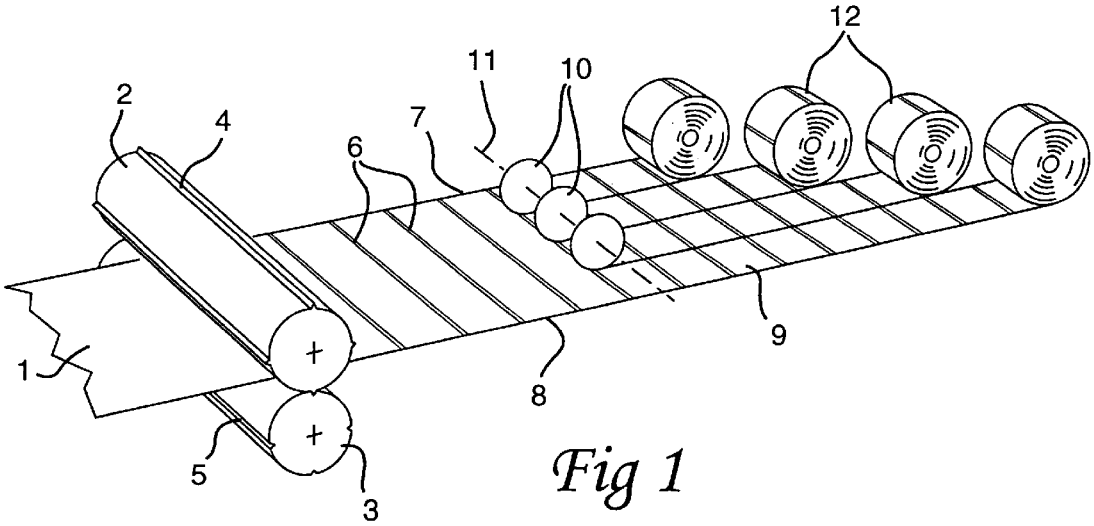

The present invention relates to a method of producing crease-lined packaging material from a web-shaped starting material which is provided with a pattern of crease lines which extend at an angle to the direction of travel of the web, and is divided into a number of tributary- or part webs.

BACKGROUND ART

In the production of packaging containers of a single-use disposable type for various types of drinks, e.g. juice and milk, use is often made of a laminated packaging material which is cut, folded and sealed for the formation of a liquid-tight, filled and sealed packaging container. A common material type consists of a laminate which comprises a central, relatively thick carrier layer of fibrous material, e.g. paper, which is coated on either side with layers of thermoplastic material. Possibly, other layers may also be included, for example barrier layers such as aluminium foil or some form of barrier plastic such as, for instance, EVOH. In order to facilitate the forming of the packaging container, the packaging laminate is weakened in a linear pattern of crease lines which, by compressing above all the carrier layer of the laminate, facilitate its folding. Normally, the crease lines extend both parallel to the longitudinal direction of the web and at different angles thereto, for example transversely or obliquely over the material web.

In the production of packaging laminates of the above-outlined type, a relatively wide web of the fibrous material subsequently forming the carrier layer of the laminate is provided with external, liquid-tight thermoplastic layers of, for example, polyethylene with the aid of a laminator unit. The plastic layers are extruded in linear configuration over the entire width of the web, and cooled compression rollers are employed to ensure that the plastic melts into and is permanently bonded to the fibrous layer. Possible additional layers of, for example, aluminium foil are thereafter applied, whereupon an external layer of liquid-tight thermoplastic completes the laminate production process. Immediately hereafter, the laminate is, in prior art production methods, provided with the desired pattern of crease lines, which is realised with the aid of two cooperating, counter-rotating rollers between which the laminate passes. The rollers, which are provided with male and female tools, respectively, compress the packaging laminate so that the desired pattern of crease lines is obtained. The thus produced and crease-lined, relatively wide web of starting material is then divided by means of cutting tools into the desired number of parallel tributary or part webs, each one of which being of a width which corresponds to the width of the material consumed for producing one packaging container of the relevant type. The part webs are then rolled up into reel form in order to be able to be stored in a compact manner until such time as the material is to be employed for being progressively converted in a filling machine into filled and sealed packaging containers. The above-described procedure usually also includes a printing process, and also possibly further treatment to provide the packaging laminate with, for example, opening arrangements, but this is not pertinent to the invention under consideration here and is, moreover, a technique known in the art, for which reason it will not be considered in greater detail in this context.

In the subsequent production of packaging containers from a tributary or part web of packaging laminate produced in the above-outlined manner, the crease lines which were produced are utilised for progressively reforming the packaging material web into the desired container configuration. In such instance, the prior art techniques display certain drawbacks, which impedes the production of the packaging containers and leads to a poorer result. A first drawback is that the crease lines, when the packaging material is to be reformed into individual packaging containers, prove to have insufficient weakening effect on the material, which impedes the folding operation and gives less clearly defined edges on the packaging container. One reason for the poorer crease quality has proved to be the fact that the creasing is already undertaken in connection with the production of the packaging laminate, when the fibrous layer serving as carrier layer displays a relatively high moisture content deriving from the manufacturing process. In such instance, the moisture content results in the material—in connection with the creasing operation—being compressed together in an elastic rather than a plastic manner, with the result that the fibrous material compressed in the crease lines will, after storage of the wound-up part webs for some time, partly return to their original form so that the crease lines have a lower weakening effect.

A further drawback which is inherent in the described, prior art method is that the division of the relatively wide, web-shaped starting material into four to eight narrower tributary or part webs takes place in that the starting material is caused to pass a number of cutting blades uniformly disposed on a common shaft. The mutual spacing of the cutting blades is, in such instance, fixed and the transverse position of the cutting blades in relation to the web-shaped starting material is controlled by the one edge of the web. Possible errors or inaccuracies in the positioning, as well as the necessary cutting tolerances in the individual blades, will in this instance lead to the accumulation of inaccuracy across the width of the web being so great that, in unfortunate cases, the incisions are placed in poor register with the crease pattern existing in the material. More precisely, the distance between the two longitudinal edges of the part web and the longitudinal crease lines stamped in the web will not agree with the desired pattern, which impedes the forming operation and leads to undesirable circumferential variation in the finished packaging containers.

One wish in the art of packaging material manufacture is therefore to realise a method of producing crease-lined packaging material, the method obviating the above-considered drawbacks and ensuring, on the one hand, a sufficiently accurate end result in the manufacture of laminated crease-lined packaging material and, on the other hand, that the crease lines stamped in the material have the desired material-weakening properties.

OBJECTS OF THE INVENTION

One object of the present invention is to realise a method of producing a crease-lined packaging material, the method making it possible to realise crease lines with the correct, material-weakening properties without the method being unduly complex or additional, costly production stages needing to be undertaken.

A further object of the present invention is to realise a method of producing a crease-lined packaging material, the method making it possible to reduce the tolerance limits for spacing variations between the longitudinal edges of the produced tributary or part webs and the crease lines of the crease pattern running in parallel with the longitudinal edges of the part webs.

A further object of the present invention is to make for a method of manufacturing crease-lined packaging material, the method not only making it possible to control the material weakening caused by the crease line pattern, but also to selectively choose different degrees of weakening for crease lines respectively extending transversely and longitudinally in relation to the web.

Yet a further object of the present invention is finally to realise a method of producing a crease-lined packaging material, the method making it possible to obviate all of the above-outlined drawbacks from which prior art methods suffer.

SOLUTION

The above and other objects have been attained according to the present invention in that a method of producing crease-lined packaging material from a web-shaped starting material which is provided with a pattern of crease lines extending at an angle to the direction of travel of the web and is divided into a number of tributary or part webs, has been given the characterizing feature that each part web, after division of the starting material, is provided with a longitudinal crease line which is oriented in parallel with the longitudinal edges of the part webs.

Preferred embodiments of the method according to the present invention have further been given the characterizing features as set forth in the appended subclaims.

By separating in time, according to the present invention, the production of transverse and longitudinal crease lines, respectively, it will be possible to relate the spacing of the longitudinal crease lines to the longitudinal edge line of the individual part web, which gives better precision and obviates an accumulation of any possible inaccuracies in the relationship between the edge line of the web and the creasing tool. Since the longitudinal creasing in accordance with the method according to the present invention is moreover undertaken after the storage of the material and immediately prior to the manufacture of the individual packaging container, the crease lines stamped in this instance will, on the one hand, be independent of the moisture content of the material and, on the other hand, be produced immediately before they are to be employed for folding the material, which ensures that the desired weakening effect is obtained. Moreover, transverse and longitudinal crease lines will respectively have different weakening effects, which is a particular need in the production of certain types of packaging containers, as will be described in greater detail hereinbelow.

BRIEF DESCRIPTION OF THE ACCOMPANYING DRAWING

Figure 2:
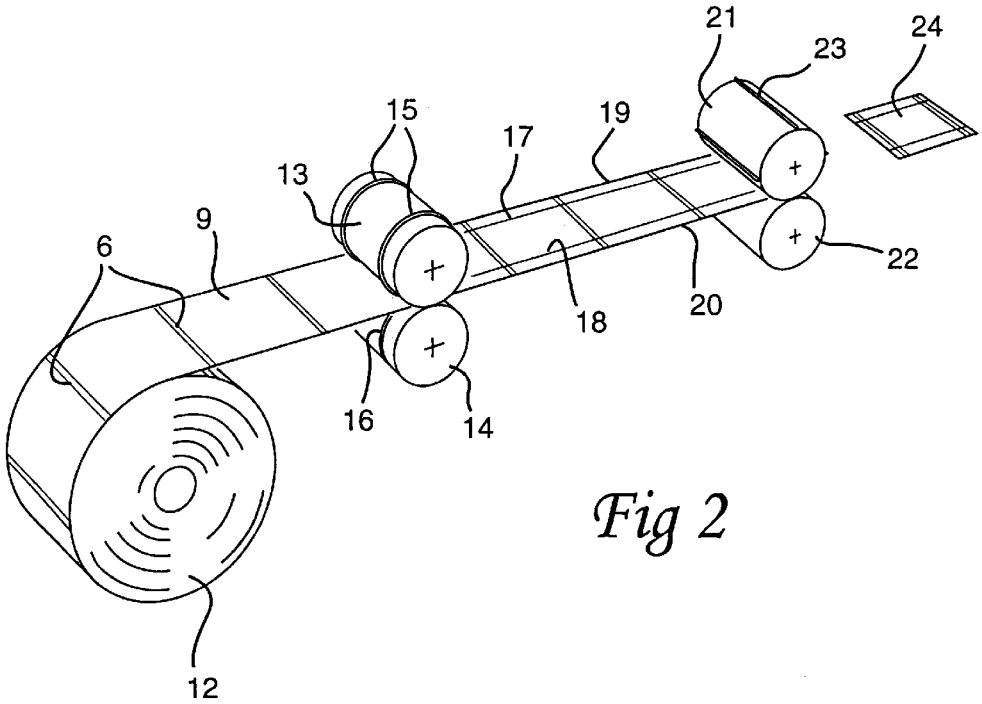

One preferred embodiment of the method according to the present invention will now be described in greater detail hereinbelow, with particular reference to the accompanying, schematic Drawing which shows only those details indispensable to an understanding of the present invention. In the accompanying Drawing:

FIG. 1 is a perspective view showing how a relatively wide, web-shaped starting material is provided with transverse crease lines and divided into individual tributary or part webs; and FIG. 2 is a perspective view showing how an individual tributary or part web is provided with longitudinal crease lines and divided into individual packaging container blanks.

DESCRIPTION OF PREFERRED EMBODIMENT

FIG. 1 shows a part of the production cycle for a laminated, web-shaped packaging material. The packaging material is of per se known type and comprises, for example, a central carrier layer of fibrous material, preferably paper, which is coated on either side with liquid-tight layers of thermoplastic material, for example polyethylene. The packaging laminate may, as required, include further layers, for example a gas barrier layer such as aluminium foil or other layers to impart to the overall packaging laminate the desired properties.

The major part of the production method for a packaging laminate of this type is known in the art and will not be described in greater detail in this context. However, it should be noted that the production takes as its point of departure a wide, web-shaped material web of fibrous material which is to form the carrier layer of the laminate. The paper web is supplied from a paper mill and is provided, in the packaging material production, with the outer layers of thermoplastic material either in that these are extruded onto the web, i.e. the plastic is caused in the molten state to pass through elongate extruder nozzles disposed transversely over the web in order thereafter to run down onto the web to which it compressed with the aid of cooled rollers abutting against the web. It is naturally also possible to apply the layers in the form of prefabricated plastic films which, with suitable adhesive and heat/pressure, are bonded to the fibrous carrier layer. Once the packaging laminate has thus been provided with the desired number of layers of paper, plastic, aluminium foil or the like, it forms a web-shaped starting material 1 which is led into the nip between two driven rollers 2 and 3 which rotate in opposite directions. The roller 2 is provided with a pattern of crease bars 4 which cooperate with a corresponding pattern of recesses 5 in the roller 3. The rollers 2 and 3 are thus driven synchronously with each other and with the speed of the web 1 of starting material running from left to right in FIG. 1. As a result of the abutment of the rollers 2 and 3 against one another and the interjacent material web, there is formed in the web a pattern of crease lines 6 which, in the illustrated embodiment, extend transversely in relation to the longitudinal direction of the web 1, i.e. substantially at a right angle to the longitudinal edges 7 and 8 of the web. Naturally, the two rollers 2, 3 may also be provided with complementary patterns of creasing tools extending more or less transversely in relation to the web, for example for realising crease lines extending at an angle of 45° to the two edges 7 and 8 of the web. Naturally, the web may also at this stage be provided with one or more longitudinally extending crease lines.

When the web-shaped starting material has thus passed the roller pair 2, 3, it displays a number of crease lines 6. Since the width of the starting material constitutes a multiple of desired width to produce each individual packaging container, the starting material 1 is thereafter divided into a number of narrower tributary or part webs, for example four, six or eight in number. Each part web 9 is thus of a width which corresponds to the width of the blank which is required for manufacturing individual packaging containers. The division of the starting material web 1 into the individual part webs 9 takes place with the aid of cutting devices 10 which are disposed with relatively uniform distribution over the width of the starting material web 1. The common centre shaft 11 of the cutting devices 10 extends transversely over the starting material web 1 and is guided (not shown) along the one edge of the starting material web, which thus determines the position of the individual incisions between the part webs 9 and the above-mentioned edge 7, 8 of the starting material web. The individual spacing between the different cutting devices 10 is adjusted in such a manner that the part webs 9 are given the same width dimension, but naturally cutting tolerances and adjustment inaccuracies will still give certain variations as regards the transverse positions of the incisions in relation to the longitudinal edges 7, 8 of the starting material web 1.

After the web-shaped starting material 1 has been divided into individual part webs 9, these are rolled up into individual reels 12 which thus consist of laminated and creased packaging material intended to be placed in a filling machine of known type and be converted into individual, filled and sealed packaging containers. The described production method in practice also includes additional operational phases which, however, have no bearing on the method according to the present invention and moreover are well-known to a person skilled in the art, for which reason the technique or method is not likely to need any more detailed description in this context. Above all, the laminate production of the above-outlined type normally also includes a printing process so as provide the packaging material with the desired artwork pattern as well as various identification and control markings. Possibly, a production step is also included for providing opening arrangements, drinking straw holes, tear-off indications or other irregularities.

As was previously mentioned, the part webs 9 rolled up into the form of reels 12 are, after the above-considered production phase, normally placed in some form of storage pending delivery to the filling machine where each respective part web 9 is to be converted into individual packaging containers. The time elapsing between the production and the conversion of the part webs 9 into packaging containers naturally varies greatly, but a storage time of two to three months is not uncommon. During storage, the properties of the material change somewhat, among other things in a period of storage in any event of lengthy duration, the moisture content of the fibrous material forming the carrier layer will change. When the packaging laminate was originally manufactured, this takes place with a fibrous material which displays a relatively high moisture content, which derives from the papermaking process. On storage of the material, a progressive drying out takes place, with the result that the moisture content in the carrier layer of the laminate is considerably reduced. This is of importance to the continued conversion of the part web 9 into the individual packaging containers, as will be described below.

As is apparent from FIG. 2, a part web 9 in the form of a reel 12 has been placed in a reel frame (not shown) at the inlet end of a filling machine (not shown) of known type, e.g. the type which is described in European Patent No. 102.616. When the filling machine is in operation, the part web 9 is reeled off progressively and is led first in between a cooperating pair of crease rollers 13, 14 which, like the previously mentioned pair of crease rollers 2, 3, are disposed transversely in relation to the material web and are driven in opposite directions synchronously with both the material web and with each other. The crease roller 13 displays a pattern of crease bars 15 and the crease roller 14 displays a corresponding pattern of cooperating recesses 16. On rotation of the crease rollers 13, 14, the recesses 16 and crease bars 15 create a complementary pattern of one or more longitudinal crease lines 17, 18 on the part web 9. The crease lines 17, 18 extend along both longitudinal edges 19, 20 of the part web 9, and also serve as a guide for the part web 9 and determine its transverse position in relation to the crease rollers 13 and 14. After having passed the crease rollers 13 and 14, the part web 9 is led in between a further pair of cooperating rollers 21 and 22 which are synchronised with the movement of the web 9 and mutually interconnected in order to rotate at the same speed in opposite directions. The rollers 21, 22 display transverse cutting tools 23 which divide the part web 9 into individual blanks 24 of the desired width and length in order to be able to be converted into packaging containers of the desired size and configuration. The further conversion of the blanks 24 into individual packaging containers may be put into effect in any optional manner and does not form any germane part of the present invention, for which reason no description of this operational phase will be given here.

The production of longitudinal crease lines 17, 18 in connection with the conversion of the part web 9 into individual packaging containers in a filling machine ensures that the weakening effect of the crease lines is optimal in that instant when the crease lines are to be utilised to facilitate the folding of the packaging material. This is partly because the crease lines are created immediately before they are to be used, but also because the material has, in connection with its storage, dried out so that the moisture content of the fibrous layer is lower and, as a result, the compression of the fibrous layer in connection with the creasing operation will be of a more plastic nature. Since the transverse crease lines 6 are created while the moisture content of the material is still high, the effect of these crease lines in connection with the folding of the material will be less than the effect of the later created longitudinal crease lines, which is an advantage since the handling of the web material—both before and during the production of the individual packaging containers—involves both stretching and compression of the part web 9 in the longitudinal direction, which, with overly accentuated crease lines, readily results in a deformation of the material. The longitudinal crease lines 17, 18 are not subjected to any corresponding stresses and can, as a result, have a greater material-weakening effect without any inconvenience. Since the material, after having been divided into individual blanks 24, is often folded over along its longitudinal main crease lines for the formation of sleeve-shaped packaging container casings (where the longitudinal crease lines will extend vertically), this is of major importance for ensuring that the casings have a correct transverse dimension, which in its turn is of importance for the continued conversion into individual packaging containers. The production of the longitudinal crease lines 17, 18 in connection with the conversion of the material into individual packaging containers in a filling machine also entails that the creasing operation takes place at a considerably lower tempo than the creasing operation which is carried out in connection with the material production, on which occasion, the material web is often transported at a speed of between 300 and 400 m/min. By way of comparison, it might be mentioned that a typical web speed in a filling machine is between 15 and 80 m/min. This favourably influences accuracy, and the placing of the longitudinal crease lines 17, 18 will, as was mentioned previously, also be more exact because of the fact that the creasing at the part web 9 may be put into effect with direct guiding from the edges 19, 20 of the part web, and so no accumulation of any possible errors or inaccuracies takes place. In practice, the method according to the present invention has proved to function well and the errors and inaccuracies associated with prior art production technology have been almost entirely obviated. The produced packages will be more exact, with more accurate dimensions, straight edges and less damage.

The present invention should not be considered as restricted to that described above and shown on the Drawing, many modifications being conceivable without departing from the scope of the appended claims.

What is claimed is:

1. A method of producing crease-lined packaging material comprising:

providing a web-shaped starting material having a first pattern of crease lines which extend at an angle to a direction of travel of the web, dividing the starting material into a predetermined number of tributary- or part webs, and thereafter, providing each of the part webs with at least one longitudinal crease line which is oriented in parallel with a longitudinal edge of the part web.

2. The method as claimed in claim 1, wherein, after said dividing step and prior to said longitudinal creasing step, each part web is rolled up in order to be transported to a filling machine in which it is once again reeled off during simultaneous longitudinal creasing.

3. The method as claimed in claim 1, wherein the longitudinal crease lines of the part webs are created by means of rollers extant in a filling machine and between which the part web is fed prior to division into individual container blanks and reforming into individual packaging containers.

4. The method as claimed in claim 1, wherein the longitudinal crease lines of the part webs are placed vertically in relation to a finished packaging container.

5. The method as claimed in claim 1, further comprising converting said part web to form a finished packaging container, said step of providing the part web with at least one longitudinal crease line occurring immediately prior to said converting step.

6. A method of producing crease-lined packaging material comprising:

forming a web material piece, said web forming step including providing a web-shaped starting material, providing a first pattern of crease lines which extend at an angle to a direction of travel of the starting material, and dividing the starting material into a predetermined number of web material pieces, and thereafter, forming a finished packaging container, said container forming step including creasing each of the web material pieces with at least one longitudinal crease line which is oriented in parallel with a longitudinal edge of the web material piece, dividing the longitudinally-creased web material piece into a plurality of individual container blanks, and converting the blanks so as to form the finished packaging container.

7. The method as claimed in claim 6, wherein said container forming step further comprises filling the finished packaging container and thereafter, sealing the finished packaging container.

* * * * *